US007658832B2

(12) United States Patent
Molokov et al.

(10) Patent No.: US 7,658,832 B2
(45) Date of Patent: Feb. 9, 2010

(54) STABILISATION OF LIQUID METAL ELECTROLYTE SYSTEMS

(75) Inventors: Sergei Molokov, Coventry (GB); Alex Lukyanov, Coventry (GB); Gennady El, Coventry (GB)

(73) Assignee: Coventry University, Coventry (GB)

( * ) Notice: Subject to any disclaimer, the term of this patent is extended or adjusted under 35 U.S.C. 154(b) by 0 days.

(21) Appl. No.: 12/171,898

(22) Filed: Jul. 11, 2008

(65) Prior Publication Data

US 2009/0055108 A1 Feb. 26, 2009

Related U.S. Application Data

(62) Division of application No. 10/501,279, filed as application No. PCT/GB03/00072 on Jan. 10, 2003, now abandoned.

(30) Foreign Application Priority Data

Jan. 10, 2002 (GB) ..... 0200438.0

(51) Int. Cl.
*C25C 3/06* (2006.01)

(52) U.S. Cl. ..... 205/339; 205/336; 204/247.1; 204/247.4

(58) Field of Classification Search ..... 204/243.1, 204/247.1, 247.4; 205/336, 339
See application file for complete search history.

(56) References Cited

U.S. PATENT DOCUMENTS 4,090,930 A 5/1978 Morel et al.
4,201,635 A 5/1980 Muller
4,565,748 A 1/1986 Dahl
4,713,161 A 12/1987 Chaffy et al.
4,976,841 A 12/1990 Boivin
5,240,569 A * 8/1993 Waldron ..... 205/799

FOREIGN PATENT DOCUMENTS

| | | |
|---|---|---|
| CN | 86103689 | 7/1989 |
| GB | 2 041 409 A | 9/1980 |
| RU | 94029216 A1 | 6/1996 |
| WO | WO 00/44963 A | 8/2000 |

OTHER PUBLICATIONS

A. Lukyanov et al., *Instability of MHD-Modified Interfacial Gravity Waves Revisited*, Physics Letters, vol. 290, Nov. 21, 2001, pp. 165-172.

Davidson, *Overcoming Instabilities in Aluminum Reduction Cells: A Route to Cheaper Aluminum*, Materials Science and Tech., vol. 16, May 2000, pp. 475-479.

* cited by examiner

*Primary Examiner*—Bruce F Bell
(74) *Attorney, Agent, or Firm*—Workman Nydegger

(57) ABSTRACT

A method of stabilizing an electrolysis cell with a boundary, a liquid metal layer and an electrolyte layer having specific operational and geometric parameters, and comprises the steps of determining amplitude and frequency values for a desired external, time-varying and/or alternating magnetic field through wave reflection analysis on a theoretical wall whose parameters are representative of the cell wall's parameters; and imposing on said cell an external, time-varying and/or alternating magnetic field having substantially the same amplitude and frequency values determined in the wave reflection analysis so that the resultant magnetic field imposed on the cell tends to parametrically and dynamically desynchronize the occurrence of resonance instability near the cell's walls.

7 Claims, 6 Drawing Sheets

STABILISATION OF LIQUID METAL ELECTROLYTE SYSTEMS

CROSS-REFERENCE TO RELATED APPLICATIONS

This application is a divisional application of U.S. patent application Ser. No. 10/501,279, filed Jul. 9, 2004, which is a nationalization of PCT Application Serial No. PCT/GB2003/00072, filed Jan. 10, 2003, which claims priority to United Kingdom Patent Application No. 0200438.0, filed Jan. 10, 2002, which are incorporated herein by specific reference.

BACKGROUND OF THE INVENTION

1. The Field of the Invention

The invention relates to liquid metal electrolyte systems and is especially, though not exclusively, applicable to improving the efficiency and reducing the operating costs of modern-day aluminium reduction cells.

2. The Relevant Technology

The invention will be exemplified, and will subsequently be described and illustrated in this present specification, with reference to aluminium reduction or smelting.

Modern aluminium production plants consume huge amounts of electricity.

Virtually all of them operate by reducing alumina in electrolysis cells or, as they are called, pots. In practise a commercial aluminium smelting plant will consist of several hundred such pots and will operate on a continuous production basis.

There are two remarkable features of this process. First, it has remained virtually unchanged for over a century since it was first successfully developed (and indeed it is still universally known as the Hall-Héroult process after the two scientists who first independently discovered it). Second, the amount of energy consumed by the process is quite staggering.

It has been estimated that the modern-day production of aluminium consumes about two percent of all electricity generated worldwide (!) and yet much of this energy is absorbed in overcoming resistive losses in the poorly conductive highly resistive electrolyte layer of each individual smelting cell. The primary electrical driving current can be of low voltage but must be of relatively enormous amperage in order for the process to work, given these drawbacks, and it follows that any modification which enables that current, the electrolyte thickness, or both, to be reduced at all would indeed produce reductions in energy consumption which could truly be described as significant in relation to those needed without the modification today.

Efforts have been made, naturally, to overcome this problem but the main limiting factor is that, if the electrolyte thickness is reduced beyond a certain critical level, instabilities begin to occur at the interface between the liquid electrolyte and the liquid aluminium. These instabilities, which manifest themselves as a sloshing of the liquids within the cell, have been the subject of intensive research for some 20 years or more. In effect, these are interfacial gravity waves, modified by the external magnetic fields which pervade the cell and when a certain stability threshold is exceeded, these waves can grow by absorbing energy from the ambient electric and magnetic fields.

The good news is that the wave period is measured in minutes and its growth rate in hours, and so the problem ought to be susceptible to some controlled solution. The real problem is that once such a wave takes hold, it can disrupt the electrolysis to such an extent that the cell must be withdrawn from operation. In an extreme case, it could destroy the entire cell.

Previously proposed means for trying to eliminate these instabilities include:

- Placing baffles in the aluminium to break up the long-wavelength waves whilst relying on friction to dissipate the short-wavelength components.
- Have a sloping cathode block so that the aluminium continually drains away.
- Destroy the standing waves by placing hydraulic energy absorbers at the edges of the cell.
- Tilt the anode in harmony with the wave so that the electrolyte layer remains almost uniform and thus one eliminates the perturbation in current.

The first of these prior proposals remains simplistically attractive but both it and the second one are limited by the need to find, in practical environments, a material which survives the chemically aggressive environment in a smelting cell. The second option has another difficulty in that thin aluminium layers will not properly wet the cathode and this cannot easily or cheaply be overcome. Whilst the third option is self-explanatory, the most recent research has concentrated on the final one but as far as is known, no practical embodiment has yet emerged.

Furthermore, a paper published by Elsevier Science dated 12 Nov. 2001 by authors A. Lukyanov, G. El and S. Molokov, is deemed to be relevant to the present application as it defines the general background of the mechanism of instability, however primarily in the context of determining the reflection coefficient rather than proposing a practical solution for controlling instability in a cell as is one of the objectives of the present application.

In summary, despite the length of time the problem has been around, and the importance of modern aluminium production to the progress of industrialised society as a whole in an era when, paradoxically, conservation of energy is becoming more urgent than ever, instability of aluminium reduction cells remains the central and unsolved problem in the industry at large.

The Inventive Concept

The applicants are proposing a modification of existing current-driven liquid metal electrolyte systems (of which an aluminium reduction cell is the obvious but not limiting example) which starts from a point quite different from any of those outlined above—but which could, we believe, be used in any appropriate combination with some, all, or any of the prior proposals outlined above.

In essence, we impose on such a system an additional, external, magnetic field whose design and operating parameters are so chosen as to enable the electrolyte thickness to be reduced significantly in relation to those needed without the modification. By doing this, we address the very source of the instability, which happens due to the interaction of the currents induced by the interface motion with the external magnetic field.

Based on our understanding of the fundamental mechanism governing the instability, we believe it to be possible that, with appropriately designed coils, a ring current around the cell inducing an automating magnetic field will stabilise the cell to an appreciable if not total extent.

Thus, rather than trying to understand fully all the processes happening inside the cell we effectively suppress the fluctuations by imposing a suitably powerful and time-dependent magnetic field around it. A modern aluminium (or any other metal) reduction cell is a complex and highly optimised device. There are a multitude of supple physical and chemical processes occurring within such a cell and many of them will inevitably interact. A small change in any one parameter could well have quite unexpected consequences and these may or may not be either inter-related or predictable at all. The size alone of the primary driving current makes it almost impractical to try to make relatively small adjustments to any one aspect of cell operation—for example, the "anode-tilt" approach exemplified in the fourth prior proposal outlined previously—with any real guarantee of even partial success.

We by contrast take an overview and we believe that, with appropriate design and with the ability to adjust the controlling parameters (i.e. field amplitude, frequency, and constant background) we are more likely to achieve real suppression of instability in a practical format within the foreseeable future.

In a subsidiary aspect, the magnetic field applied is essentially a vertical magnetic field. In this direction, significant effect on instability in liquid metal electrolyte occurs which allows the thickness of electrolyte itself to be reduced below levels at which conventionally instability would occur.

In a further subsidiary aspect, the magnetic field is dependent on an amplitude and frequency whose values are approximated through wave reflection analysis on an infinite wall. This is advantageous as it allows an appropriate magnetic field to be rapidly determined rather than relying on the skilled man to determine an adequate field through more extensive analysis.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

Figure 1:
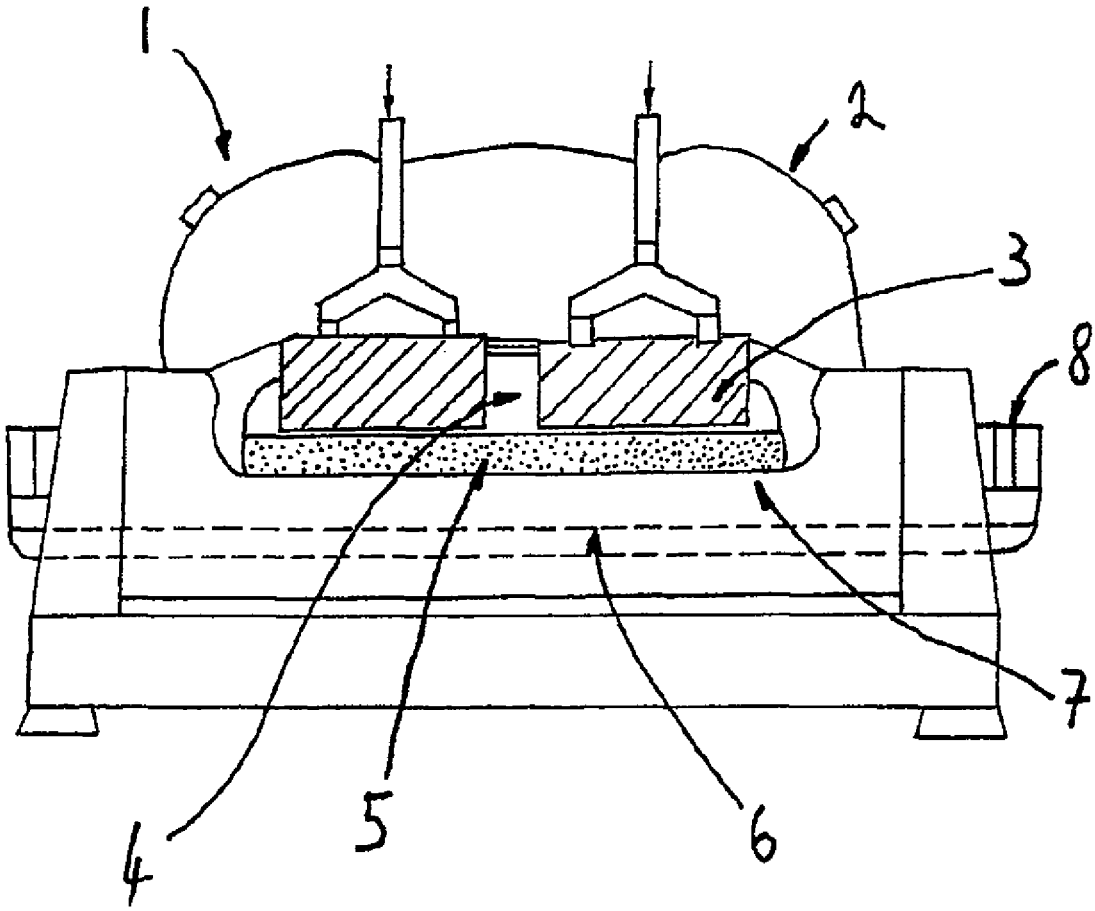
FIGURE 1 PRIOR ART
FIG. 1 shows diagrammatically an example of a modern Hall-Héroult cell.

An example of a modern Hall-Héroult cell generally referenced 1 is shown in FIG. 1. Cell 1 comprises covers 2, carbon anodes 3, molten salt electrolyte 4, molten aluminium 5, collector bars 6, carbon lining 7 and a carbon bus 8. All of these components may be of standard kind, modified or substituted if necessary by other relevant components or groups of components by the person skilled in the art without any recourse to inventive thought.

The current used in the electrolysis enters the electrolyte zone vertically through the anode and is collected by the cathode at the bottom. The thickness of both layers, electrolyte and aluminium, is very small in comparison with the horizontal dimensions. Schematically, the electrolysis zone can be presented as shown in FIG. 2.

Figure 2:
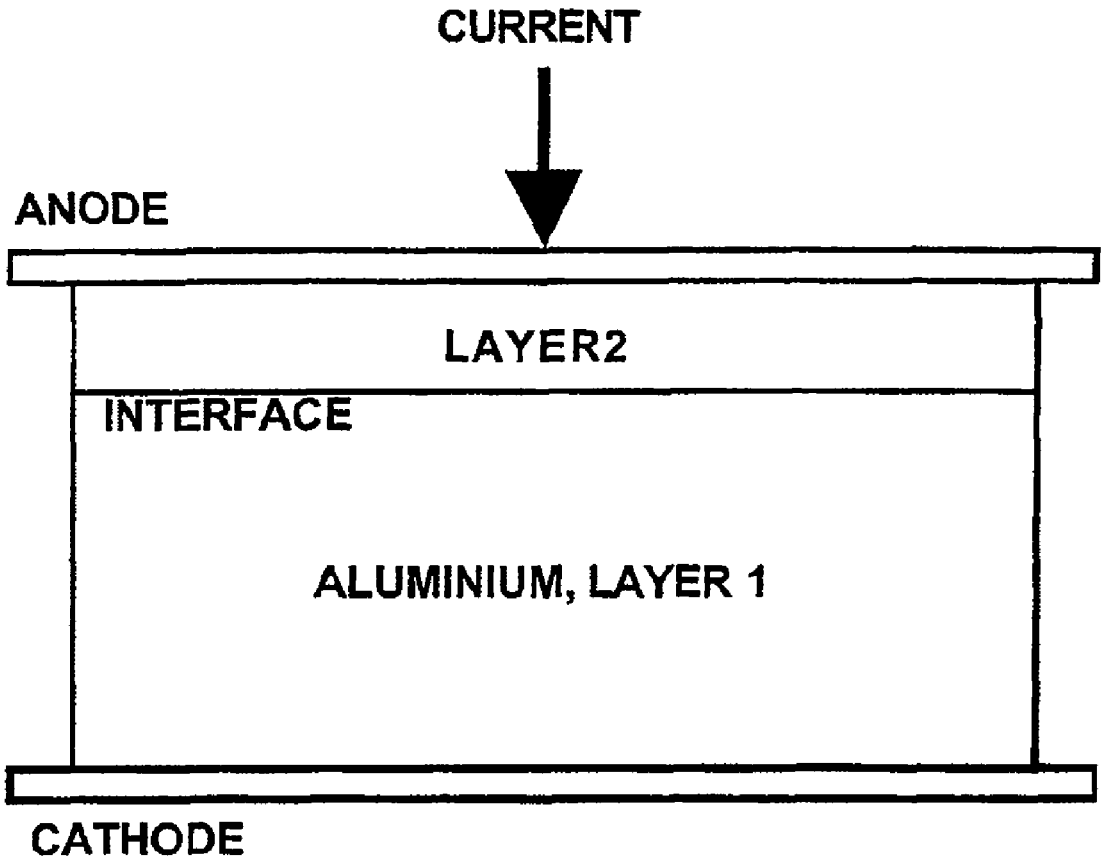
FIGURE 2 PRIOR ART
FIG. 2 presents the electrolysis zone of the cell schematically.
Figure 3:
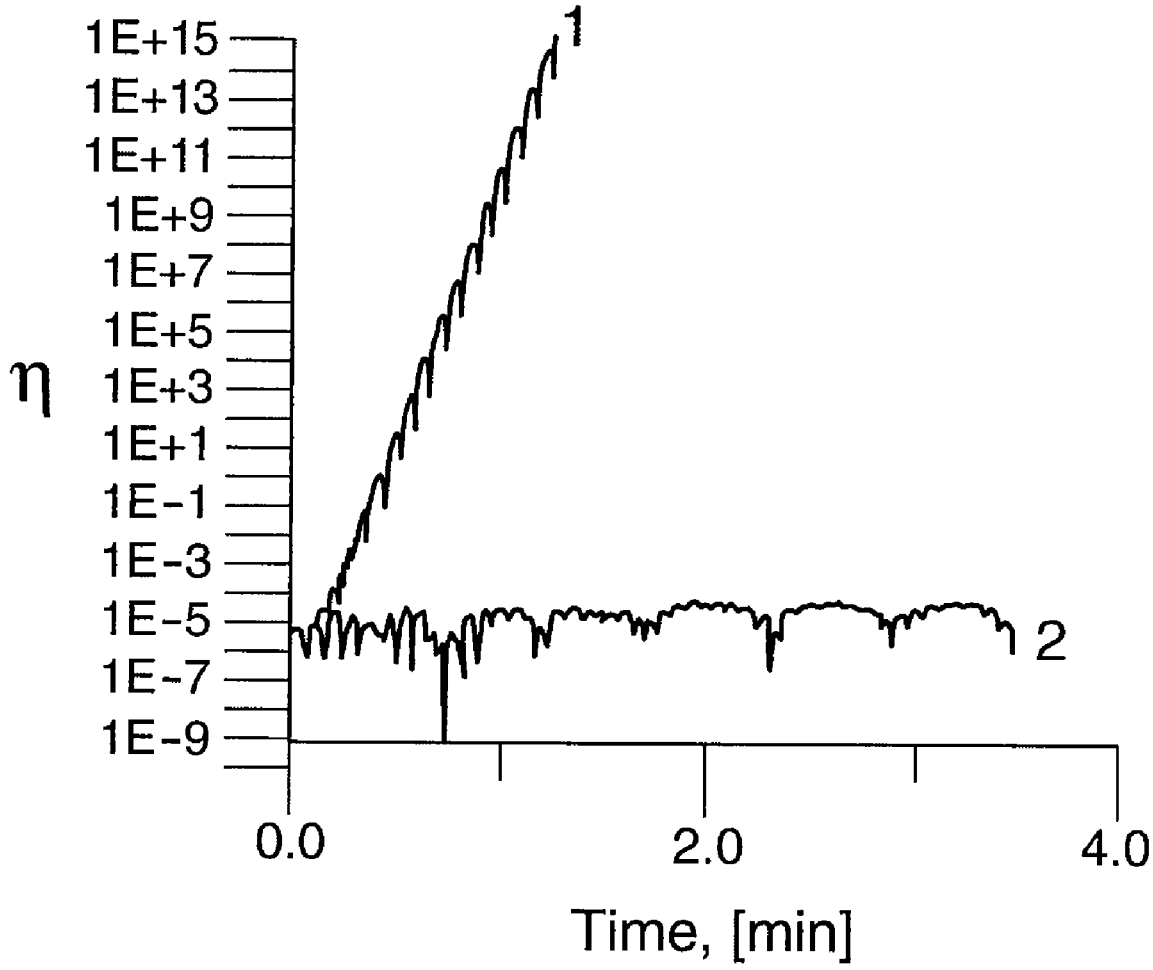
FIG. 3 shows graphically the existing and the modified instability levels occurring in respectively an unmodified and a modified cell in accordance with the invention.

The major part of the consumed energy is wasted in the form of resistive losses in the poorly conductive electrolyte, layer 2 in FIG. 2. But, when the depth of electrolyte is reduced below some critical level or the current exceeds some critical value, the cell becomes unstable. In other words, the waves at the interface between the two liquids start growing. The increment of the resulting instability is shown in FIG. 3 (curve 1).

Figure 4:
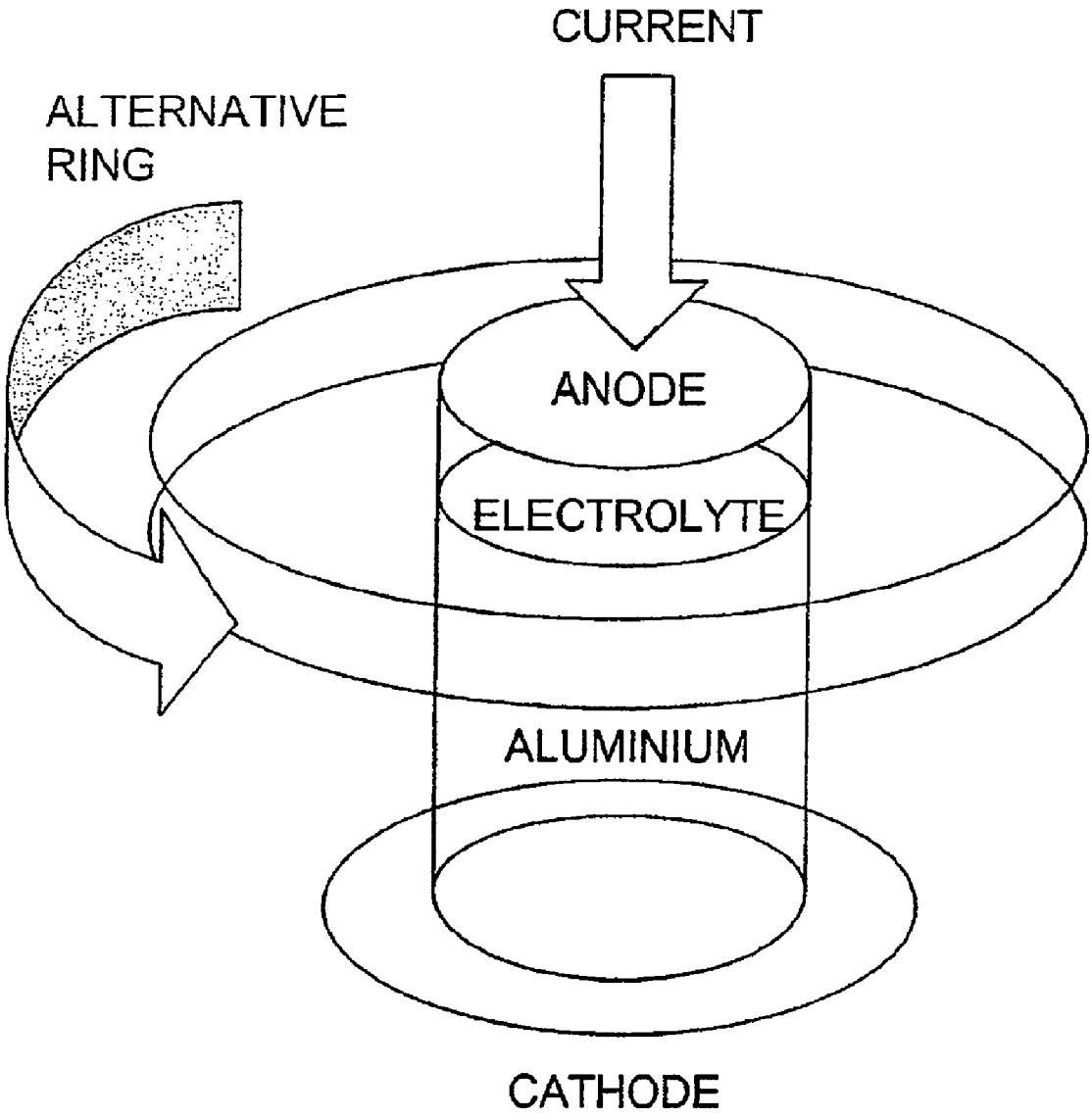
FIG. 4 shows, again in schematic form, one possible set-up embodying the invention.
Figure 8:
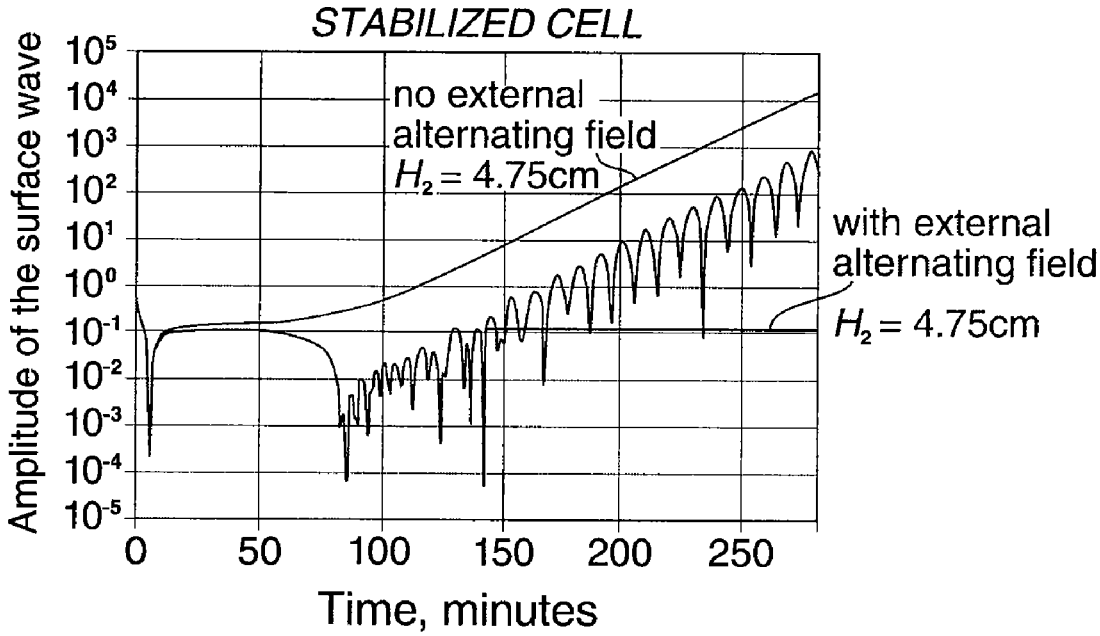
FIG. 8 shows graphically the amplitude of interfacial wave for a reduced electrolyte thickness cell with and without the alternating magnetic field.

It is proposed to apply an external, alternating magnetic field and to regulate the currents induced by this field so as to control or even suppress instability. The sketch of a possible set-up is shown in FIG. 4. In this figure a ring current around the cell induces an alternating magnetic field. In practice, the alternating magnetic field may be created, for example, by coils surrounding the cell or other means carefully selected by the person skilled in the art. The result of simulations for the circular cell, which exemplifies the most unstable case, is presented by curve 2 in FIG. 3. One can see that the instability disappears. Analysis of a more realistic, rectangular cell shows that the method works successfully in this case as well (FIG. 8). It is believed that the method may be adapted by the person skilled in the art for any cell geometry.

Description of the Underlying Theory and Exemplary Results

In the following description, flow stabilization by an alternating magnetic field is presented, and the effect of suppression of instabilities is demonstrated on an example of a two-layer system in a rectangular geometry.

Figure 5:
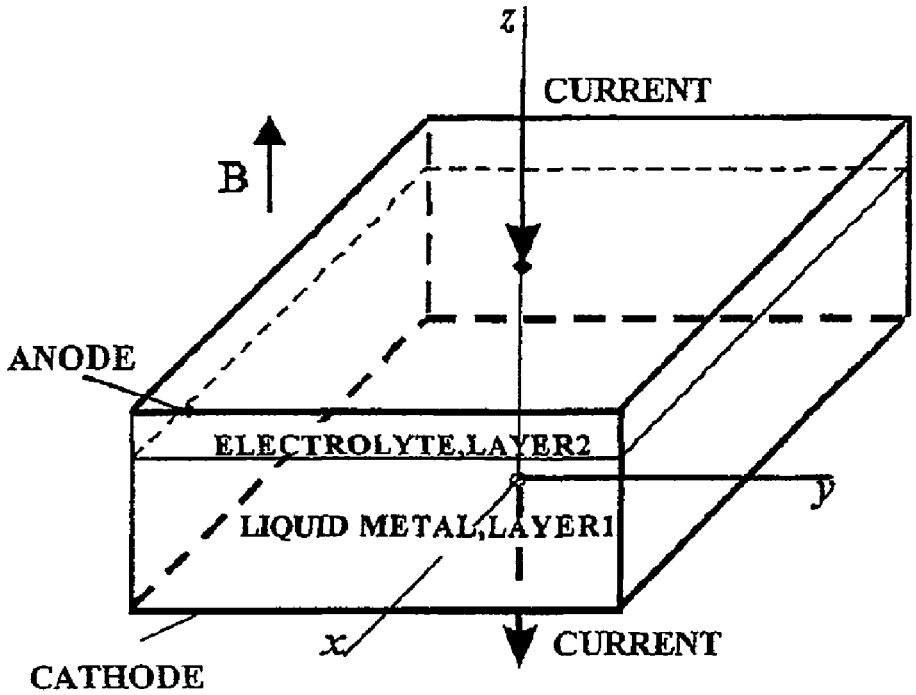
FIG. 5 shows, a schematic diagram of a two-layer system.

A) Mathematical Model of the MHD-Modified Interfacial Gravity Wave Dynamics in a Closed Domain Consider the system of two electrically conducting liquids (liquid metal and electrolyte) carrying electric current of density J and exposed to a magnetic field B presented in FIG. 5.

In the equilibrium state, $$J=J_0=(0,0,-J_0),\ B=(B_{ox},B_{oy},B_{oz}),\ \nabla\times[J_o\times B_o]=0. \tag{1}$$

Here (x,y,z) are Cartesian co-ordinates. The last relationship implies that the vertical component of the magnetic field $B_{0z}$ can be arbitrary (given by the external circuit).

Let the thickness of the liquid metal layer in the equilibrium state be $H_1$ and that of the electrolyte be $H_2$. Any deviation of the interface from the equilibrium state (which is inevitably present in a real cell) induces the redistribution of the current (and, consequently, of the magnetic field). This process is accompanied by the wave motion of the two-layer liquid system. In the absence of the electric current, the system is stable (the amplitude of the initial perturbation of the interface does not grow in the process of the wave propagation). Eventually, because of the natural dissipation in the system, the wave would fade out. In contrast, when the current is on, interaction of the current perturbation with the external magnetic field can enhance the wave motion and lead to the uncontrolled growth of the interfacial wave amplitude.

The dynamics of the two-layer system is governed by the following equations:

$$\rho_i\left[\frac{\partial u_i}{\partial t}+(u_i\cdot\nabla)u_i\right]+\nabla(P_i+\rho_i gz)=F_i-D_i \tag{2a}$$

$$\nabla\cdot u_i=0,\ \nabla\cdot J_i=0,\ \nabla\cdot B=0, \tag{2b-d}$$

where i=1, 2 is the layer number of FIG. 5; $\rho_i$ is the density; $u_i$ is the fluid velocity, $P_i$ is the hydrodynamic pressure, $J_i$ is the electric current density in the layer (which includes variations induced by the wave motion), B is the total magnetic field (which includes the field induced by the external circuit), t is time, $F_i=J_i\times B$ is the Lorentz force, $D_i$ is dissipation describing energy losses in the layer. The dissipation term is taken in the conventional form for shallow-water equations, i.e. $D_i=\nu_i u_i$, where $\nu_i$ is the dissipation coefficient.

The boundary conditions for the two-layer liquid system placed into the poorly conducting bath are:

$$(u_i\cdot n)_{bath}=0; \tag{3}$$

$$(J_{1,2}\cdot n)_{sidewalls}=0;\ (J_1\cdot n)_{bottom}=-J_0;\ (J_1\cdot n-J_2\cdot n)_{interface}=0, \tag{4a-c}$$

where n is the unit vector normal to a particular surface.

The current boundary conditions (4) imply the following ranking of conductivities: $\sigma_{sidewalls}\ll\sigma_2\ll\sigma_{bottom}\ll\sigma_1$, which is characteristic for industrial aluminium reduction cells (typically, $\sigma_1=3.3\cdot10^6$ $(\text{Om}\cdot\text{m})^{-1}$, $\sigma_2=200$ $(\text{Om}\cdot\text{m})^{-1}$, $\sigma_{bottom}=2.10^4$ $(\text{Om}\cdot\text{m})^{-1}$, $\sigma_{sidewalls}\approx0$).

The system of Equations (2), together with the boundary conditions (3), (4) fully defines the motion of the two-layer system.

In the following, the deviation of the interface z=h(x,y,t) from the equilibrium state at z=0 will be discussed. The system of governing equations (2) can be significantly simplified if two small parameters are introduced as suggested by the actual physical and engineering conditions in the aluminium reduction cells, i.e.

- $\epsilon=H_1/L\ll1$, the shallow water parameter. Here L is the horizontal dimension of the cell. Typically, $\epsilon\propto0.01$.
- $\delta=\max h/H_1\ll1$, where max h is the amplitude of the interfacial wave. That means that we are interested in the dynamics of the small-amplitude perturbations, which is perfect for the stability analysis.

Implementation of these two parameters means that to the first order in δ the motion of interface is essentially two-dimensional and the following relationships are valid:

$$u_i(x,y,z,t)\approx\delta v_i(x,y,t),\ h(x,y,z,t)\approx\delta\eta(x,y,t),\ F_i(x,y,z,t)\approx\delta f_i(x,y,t), \tag{5}$$

where $v_i$, η, $f_i$ are new, unknown, O(1) functions. These are the normalised velocity, and the perturbations of the interface and the Lorentz force, respectively.

Taking into account the shallow-water, small amplitude approximation (5), the analysis of the original equations (2)-(4) shows that to the first order in δ the following conclusions can be made:

- the current perturbation induced by the interface motion is horizontal, i.e. $J\approx J_0+j$ (x,y,t) (here and elsewhere subscript || denotes a component of a vector in the (x,y)-plane),
- the Lorentz force acting on the liquid metal depends only on the vertical component of the external magnetic field: $f_1\approx j\times B_{0Z}$,
- The Lorentz force acting on electrolyte is much less than that on the liquid metal, i.e. $|f_2\ll f_1|$.

As a result, one can conclude that by controlling the vertical component of the magnetic field $B_{0Z}$ (which is given by the external circuit) it may be possible to control the force inducing the unstable motion of the interface. One such a possibility is to superpose a certain alternating magnetic field onto the external, stationary field.

Therefore, the following form of the vertical component of the field is considered:

$$B_{oz}=B_o b(x,y,t),$$

where $B_{0Z}$ is a constant, while function b(x, y, t) can be arbitrary. In previous studies, the magnetic field has been supposed to be stationary (i.e. independent on time) and fixed.

Under all assumptions made above the system governing motion of the interface assumes the form $$\frac{\partial^2\eta}{\partial t^2}-c^2\nabla^2\eta=c^2\nabla\phi\cdot[\nabla\times b(x,y,t)e_z]-v_1\frac{\partial\eta}{\partial t}, \tag{6}$$

$$\nabla^2\phi=-\beta\eta. \tag{7}$$

Here $$\nabla\equiv e_x\frac{\partial}{\partial x}+e_y\frac{\partial}{\partial y};$$

$$c=\sqrt{(\rho_1-\rho_2)g[\rho_1/H_1+\rho_2/H_2]^{-1}}$$

is the speed of the interfacial gravity waves in the absence of the external magnetic field, $\phi(x,y,t)=\sigma_1B_0g^{-1}(\rho_1-\rho_2)^{-1}\phi(x,y,t)$ is the normalised electric potential (i.e. $j_{||}=-\sigma_1\nabla\phi$), and $\beta=J_0B_0/[H_1H_2(\rho_1-\rho_2)g]$.

It should be noted that natural dissipation in the cells plays crucial role in the stability of the existent set-ups. Typical value of the non-dimensional parameter β in this case is ~20. Without dissipation the stable operation is only possible for small values of β≈1 which are totally impractical.

The boundary conditions (3), (4) yield:

$$\frac{\partial\phi}{\partial n}=0,\ \frac{\partial\eta}{\partial n}=-b(x,y,t)\frac{\partial\phi}{\partial\tau}\ \text{at}\ \Gamma \tag{8a,b}$$

Here the function Γ(x, y)=0 defines the shape of the boundary (horizontal geometry of the cell); ∂/∂n and ∂/∂τ stand for normal and tangential derivatives to Γ=0, respectively.

Analysis of the system of Equations (6)-(8) by the skilled man in the art in the simplest case, when b≡1 (uniform, constant magnetic field), has revealed the mechanism underlying the interfacial instability. Essentially, it has been shown that the instability (if it occurs) is inspired at the boundaries of the cell by the wave reflection with the reflection coefficient greater than 1. Earlier studies missed this very point of the instability mechanism for a uniform external magnetic field. For this type of fields the first term in the right-hand side of Equation (6) vanishes, and Equation (6) becomes essentially decoupled from Equation (7). It is the boundary condition (8b) that is responsible for the development of the instability. And here is the remedy: there is an arbitrary function b(x, y, t), which is essentially the externally applied magnetic field, in this boundary condition.

Derivation from this underlying theory enables the preferred inventive external magnetic field b(x, y, t) to be found which leads to the attenuation or even suppression of instability.

Below results are presented for the simplest case of spatially uniform alternating magnetic field $$b=1+b_0\cos(\omega_0t+\theta_0) \tag{9}$$

Here $b_0$ is the normalised amplitude, $\omega_0$ is the frequency, and $\theta_0$ is the initial phase of the controlling external magnetic field which is to be obtained.

For a realistic geometry of the cell the problem defined by Equations (6)-(8) must be solved numerically. For calculations in the specific case of a rectangular cell as presented hereafter, second order central differences may be used throughout. Equation (6) may be discredited using an explicit scheme in time. A fast Poisson solver may be used to solve Equation (7).

For calculations 32 points per unit length may be used. The scheme has been successfully tested on several benchmark problems to ensure both high accuracy and the absence of numerical dispersion. Other methods of determining advantageous magnetic field types may be employed and will be selected by the person skilled in the art from known alternatives.

An approximation for parameters $b_0$ and $\omega_0$ can be advantageously obtained from the corresponding problem of a reflection from an infinite plane wall (see Sec. B). Starting from these initial estimates the frequency and the amplitude are either increased or decreased to minimize the increment of instability. The parameters are adjusted iteratively until stability of the interface is achieved.

B) Approximate Determination of the Amplitude and Frequency of the External Magnetic Field: Reflection From the Infinite Plane Wall One example of reflection analysis from an infinite plane wall is presented in this section.

Figure 6:
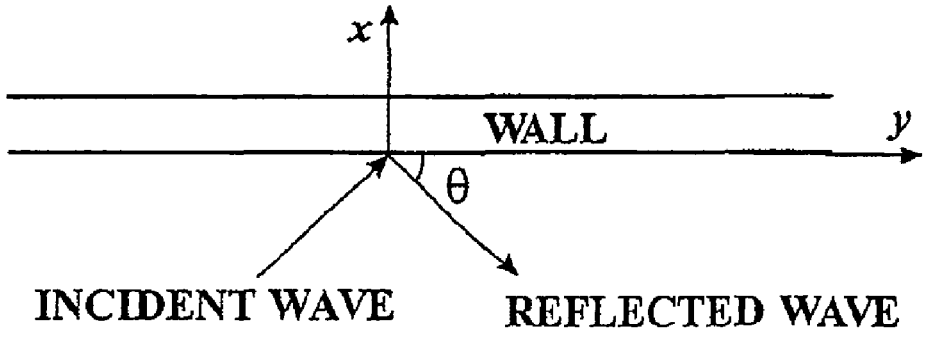
FIG. 6 shows, a schematic diagram of wave reflection on an infinite plane wall.

Both the amplitude and frequency of the controlling parameters of the external magnetic field are estimated using the simplest model of the reflection of the plane wave from the infinite boundary in the absence of dissipation as shown in FIG. 6.

In a previous study of this kind where b was assumed $\equiv 1$, the reflection coefficient $\mu$ was found to be greater than 1 for some angles of incidence. In other words, the wave was being amplified at the boundary. It is clear that in the presence of the alternating magnetic field b(t) given by Equation (9) one obtains $\mu=\mu(b_0,\omega_0)$. Now we are going to find such controlling parameters $b_0$ and $\omega_0$ that the reflection coefficient $\mu \leqq 1$. To achieve this it is convenient to represent the problem of the reflection of the plane wave from the wall in the form of the integral equation for the y-Fourier component of $\eta(x, y, t)$.

The dependent variables in the reflection problem are represented in the form $$\eta=\tilde{\eta}(x,t)\exp(ik_y y),\ \phi=\tilde{\phi}(x,t)\exp(ik_y y),$$

where $k_y$ is the wave number of the incident wave.

The Fourier-transform with respect to x leads to the following integral equation for the function $\tilde{\eta}(x,t)$ at the boundary:

$$x=0:\ \frac{\partial\tilde{\eta}}{\partial x}=-ib(t)\int_{-\infty}^{0}\tilde{\eta}(x',t)\exp(k_y x')\,dx' \tag{10}$$

while function $\tilde{\eta}(x,t)$ satisfies equation $$\frac{\partial^2\tilde{\eta}}{\partial t^2}-c^2\frac{\partial^2\tilde{\eta}}{\partial x^2}+k_y^2c^2\tilde{\eta}=0. \tag{11}$$

Applying further the Fourier transform over t i.e. $\tilde{\eta}(x,t)=\int\eta_\omega\exp(-i\omega t)d\omega$, gives the solution of Eq. (11) as follows:

$$\eta_\omega=C_1(\omega)\exp(ik_x x)+C_2(\omega)\exp(-ik_x x), \tag{12}$$

where $$k_x=\sqrt{\omega^2/c^2-k_y^2},$$

and $C_1(\omega)$, $C_2(\omega)$ are spectral powers of incident and reflected waves. Substituting Equation (12) into Equation (10) yields a functional equation, which links spectral powers of the reflected wave and the incident one, namely $$k_x(\omega)\{C_1(\omega)-C_2(\omega)\}+\left\{\frac{C_1(\omega)}{k_y+ik_x(\omega)}+\frac{C_2(\omega)}{k_y-ik_x(\omega)}\right\}+ b_0\left\{\frac{C_1(\omega\pm\omega_0)}{k_y+ik_x(\omega\pm\omega_0)}+\frac{C_2(\omega\pm\omega_0)}{k_y-ik_x(\omega\pm\omega_0)}\right\}=0. \tag{13}$$

Equation (13) can be solved iteratively assuming the spectral power of the incident wave is given, for instance $C_1(\omega)=1$. This gives the values of $b_0$ and $\omega_0$, which can be used as a starting point in our analysis of the instability in the rectangular cell with dissipation. Further, these parameters must be tuned using developed numerical code to achieve stability.

It is worth noting that Equation (10) can be used to solve a more general, inverse problem. That is, if one prescribes the spectral power of both the incident and the reflected waves, then one can obtain necessary time dependence of the controlling magnetic field b(t) rather than assuming any parametric form of the type (9) a priori.

C) Control of Instability in a Rectangular Cell

Figure 7:
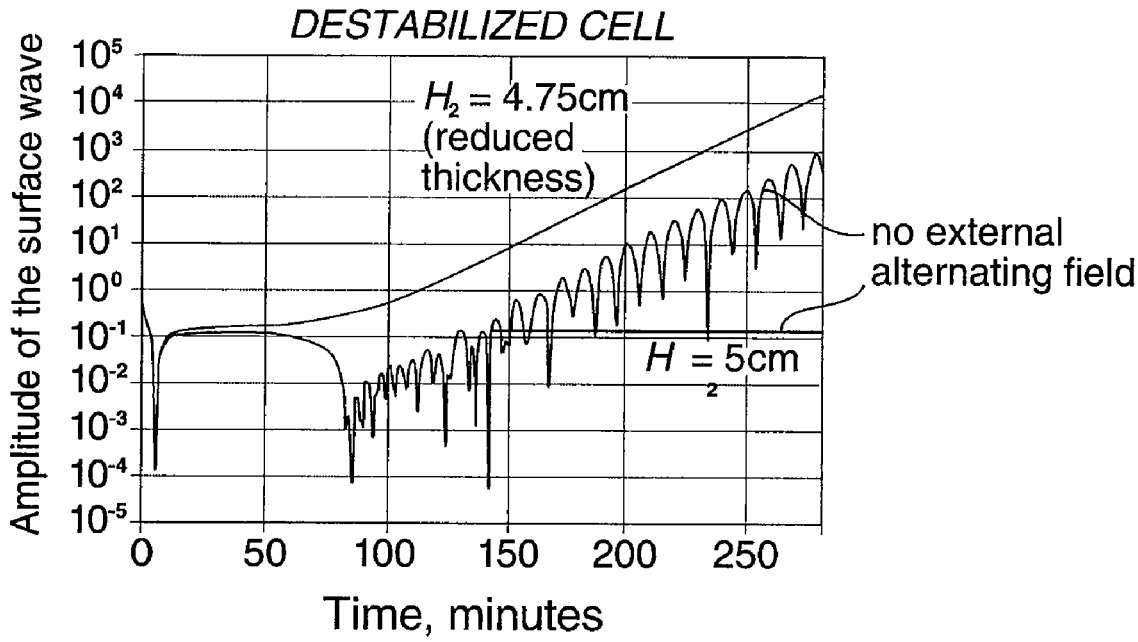
FIG. 7 shows graphically the amplitude of interfacial wave for two electrolyte thicknesses when no alternating field is applied.

The stabilizing effect of an alternating magnetic field in a rectangular cell will be demonstrated on the following example. Let the geometrical parameters of the cell be: the length $L_1$=9.8 m, the width $L_2$=3.4 m, the thickness of electrolyte layer $H_2$=5 cm and the thickness of aluminium layer $H_1$=5 cm. The total current passing through the cell is $I_c$=175 kA. The constant external magnetic field has been taken to be $B_0=3.10^{-3}$ T. These conditions correspond to a stable process of the aluminium production, which is confirmed by computer simulations and corresponds to horizontal curve in FIG. 7.

If one reduces the thickness of electrolyte layer by 5%, i.e. $H_2$=4.75, the cell becomes very unstable. Such resulting instability is shown in the growing curve of FIG. 7. As is seen, the growth rate is rather significant and after 30 minutes short-circuits occur.

FIG. 8 shows a stabilized cell with reduced thickness of an aluminium layer by an alternating field.

Operation of the cell with the same (reduced) electrolyte layer thickness but with application of an alternating magnetic field is given by Equation (9) where $b_0$=0.66, $\omega_0$=20 rad.sec$^{-1}$, $\theta_0$=0 is shown in FIG. 8.

The proper frequency $\omega_0$ and the amplitude $b_0$ have been found according to our method described in section B) and tuned to achieve stability. Starting values were not far away from those that give stable operation, i.e $b_0^{approx}\approx 1.66$, $\omega_0^{approx}\approx 40$ rad·sec$^{-1}$. Note that $b_0$ is normalised with $B_0=3.10^{-3}$ T.

As a result the cell becomes stable as FIG. 8 shows. As will be shown in the following section, this result is particularly encouraging in terms of actual energy savings.

D) Reduction of the Energy Consumption

Let's calculate energy losses in the electrolyte layer per one millimeter under the parameters listed above. The conductivity of molten electrolyte is $\sigma_c$=200 $(Om\cdot m)_{-1}$. Then in each millimeter of the electrolyte layer ($\Delta L$=1 mm) energy losses due to Joule dissipation are: $W_e=I_c^2\Delta L/(\sigma_e L_1 L_2)$=4.6 kWatt. Since the inventive magnetic field application has permitted the electrolyte layer's thickness of being reduced by $W_e=I_c^2\Delta L/(\sigma_e L_1 L_2)$=4.6 kWatt $\Delta H_2$=2.5 mm, it follows that the electric energy consumption may be reduced by $\Delta W_e$=11.5 kWatt. On the other hand, to create the stabilising external, alternating magnetic field by a coil, one needs to spend no more than $W_s$=57 Watt, provided the coil has 300 loops of copper wire of 0.5 cm in diameter.

So, the ratio is just $W_s/\Delta W_e$=0.5%. That is, the energy expenses for the production of the controlling magnetic field are very small in comparison with the resulting savings.

Two-layer systems carrying electric current in the presence of a magnetic field can be stabilized by the application of an external alternating magnetic field. Calculations for a typical geometry of an industrial aluminium reduction cell in the presence of a uniform field show that the energy losses required for stabilization are minimal.

Similar calculations may be performed for cells of various shapes and even for spatially non-uniform magnetic fields. The person skilled in the art will adapt the preceding broad underlying theory for each specific case while the current scope of the invention is defined in the claims which now follow.

What is claimed is:

1. A method of stabilising an electrolysis cell with a boundary, a liquid metal layer and an electrolyte layer having specific operational and geometric parameters, and comprising the steps of:

firstly determining amplitude and frequency values for a desired external, time-varying and/or alternating magnetic field through wave reflection analysis on a theoretical wall whose parameters are representative of the cell wall's parameters; and secondly imposed on said cell an external, time-varying and/or alternating magnetic field having substantially the same amplitude and frequency values determined in the wave reflection analysis so that the resultant magnetic field imposed on the cell tends to parametrically and dynamically desynchronize the occurrence of resonance instability near the cell's walls.

2. A method according to claim 1, wherein the imposed magnetic field is of the form $b=1+b_0(x,y)\cos(\omega_0 t+\theta_0)$, where $b_0$ is the normalized amplitude, $\omega_0$ is the frequency, and $\theta_0$ is the initial phase of the controlling external magnetic field which is to be obtained.

3. A method according to claim 1, comprising the step of solving the following equation to derive the imposed magnetic field:

$$\frac{\partial^2\eta}{\partial t^2} - c^2\nabla^2\eta = c^2\nabla\phi\cdot[\nabla\times b(x,y,t)e_z] - \nu_1\frac{\partial\eta}{\partial t},$$

$$\nabla^2\phi = -\beta\eta, \text{ and}$$

$$\frac{\partial\phi}{\partial n} = 0,\ \frac{\partial\eta}{\partial n} = -b(x,y,t)\frac{\partial\phi}{\partial\tau} \text{ at } \Gamma.$$

4. A method according to claim 1, comprising the step of deriving said field through the analysis of the reflection on a theoretical infinite wall.

5. A method according to claim 1, comprising the step of applying said field at said cell boundary.

6. A method according to claim 1, comprising the step of carrying out analysis on a rectangular cell wall and adapting it to suit other geometries.

7. A method according to claim 1, comprising the step of applying said analysis essentially only one section of the cell.

* * * * *